US009771907B2

(12) United States Patent
Meek et al.

(10) Patent No.: US 9,771,907 B2
(45) Date of Patent: Sep. 26, 2017

(54) FUEL INJECTOR

(71) Applicants: WESTPORT POWER INC., Vancouver (CA); DELPHI INTERNATIONAL OPERATIONS LUXEMBOURG S.À.R.L., Bascharage (LU)

(72) Inventors: George A. Meek, Lydney (GB); Lukhbir Panesar, Feltham (GB)

(73) Assignees: Westport Power Inc., Vancouver (CA); Delphi International Operations Luxembourg S.A.R.L., Bascharage (LU)

( * ) Notice: Subject to any disclaimer, the term of this patent is extended or adjusted under 35 U.S.C. 154(b) by 0 days.

(21) Appl. No.: 14/892,990

(22) PCT Filed: Apr. 29, 2014

(86) PCT No.: PCT/EP2014/058650
§ 371 (c)(1),
(2) Date: Nov. 20, 2015

(87) PCT Pub. No.: WO2014/187649
PCT Pub. Date: Nov. 27, 2014

(65) Prior Publication Data

US 2016/0169172 A1 Jun. 16, 2016

(30) Foreign Application Priority Data

May 21, 2013 (GB) ..... 1309126.9

(51) Int. Cl.
*F02M 51/00* (2006.01)
*F02M 43/04* (2006.01)

(52) U.S. Cl.
CPC ..... *F02M 51/005* (2013.01); *F02M 43/04* (2013.01)

(58) Field of Classification Search
CPC ..... F02M 51/005; F02M 43/04
(Continued)

(56) References Cited

U.S. PATENT DOCUMENTS 5,769,391 A * 6/1998 Noller ..... F02M 51/061 239/585.4
6,601,556 B2 * 8/2003 Nakano ..... B29C 65/606 123/184.61

(Continued)

FOREIGN PATENT DOCUMENTS

CN 1145653 A 3/1997
EP 0 740 068 B1 10/2006

(Continued)

OTHER PUBLICATIONS

Chinese Search Report, dated Jul. 19, 2017, for Chinese Application No. 2014800272822, 4 pages (with English translation).

*Primary Examiner* — Joseph Dallo
*Assistant Examiner* — Yi-Kai Wang
(74) *Attorney, Agent, or Firm* — Seed IP Law Group LLP

(57) ABSTRACT

A fuel injector for an internal combustion engine includes an injector body, a first actuator for controlling movement of a first valve needle for injecting a first fuel into a cylinder of the engine, and a second actuator for controlling movement of a second valve needle for injecting a second fuel into the cylinder. Each of the actuators are axially spaced along a longitudinal axis of the injector body and has a respective conductive element for carrying current to the actuator, the injector further includes an electrical connector module which has first and second electrical connectors for connection with an associated one of the conductive elements for the actuators. The electrical connector module is mounted between the first and second actuators along the longitudinal axis of the injector body.

20 Claims, 3 Drawing Sheets

(58) Field of Classification Search
USPC ..... 123/472
See application file for complete search history.

(56) References Cited

U.S. PATENT DOCUMENTS

| | | | | |
|---|---|---|---|---|
| 9,453,483 | B2 * | 9/2016 | Kim | F02M 63/008 |
| 2002/0020383 | A1 | 2/2002 | Nakano et al. | |
| 2004/0108395 | A1 * | 6/2004 | Hamada | F02M 51/005 239/585.1 |
| 2008/0315008 | A1 * | 12/2008 | Coldren | F02M 51/005 239/88 |
| 2012/0325180 | A1 | 12/2012 | Montgomery | |
| 2013/0047964 | A1 | 2/2013 | Kim | |
| 2013/0098333 | A1 * | 4/2013 | Kim | F02M 43/04 123/445 |

FOREIGN PATENT DOCUMENTS

| | | | |
|---|---|---|---|
| WO | 00/15956 | A1 | 3/2000 |
| WO | 02/46599 | A1 | 6/2002 |
| WO | 2004/005698 | A1 | 1/2004 |

* cited by examiner

FUEL INJECTOR

FIELD OF THE INVENTION

The present invention relates to a fuel injector suitable for controlling the delivery of two different fuels into an internal combustion engine. In particular, but not exclusively, the invention relates to a fuel injector suitable for injecting a gaseous fuel and a liquid fuel.

BACKGROUND TO THE INVENTION

Internal combustion engines for heavy-duty and industrial applications are typically fuelled by diesel. However, the use of natural gas as an alternative to diesel is of increasing interest. Natural gas is relatively abundant and relatively cheap, and can, in principle, provide similar levels of power to diesel whilst producing lower particulate and nitrogen oxide (NOx) emissions.

Natural gas can be used in place of diesel to fuel a compression-ignition engine, in which combustion of the fuel occurs as a result of compression of the air-fuel mixture in the cylinder. However, because natural gas has a higher auto-ignition temperature than diesel, it can be necessary to initiate combustion with a pilot injection of diesel fuel before introducing the natural gas to the combustion chamber.

In one type of natural gas-powered engine, known as a high-pressure direct injection (HPDI) engine, both natural gas and diesel are injected directly into the combustion chamber. Due to the space constraints in an engine cylinder head, it is desirable to inject both fuels using one fuel injector per cylinder. This requires a fuel injector that is specially adapted to keep the two fuels separate within the injector, and to deliver independently the respective fuel at the appropriate time.

One such 'dual fuel' injector is described in International Patent Application Publication No. WO 00/15956. In this example, a fuel injector with a concentric twin nozzle arrangement is provided. Inner and outer valve needles are engageable at their lower ends with respective valve seats to control the flow of fuel through respective inner and outer sets of outlets. The outer valve needle controls the injection of natural gas through the outer set of outlets, and the inner valve needle controls the injection of diesel through the inner set of outlets. The outer valve needle is tubular to accommodate the inner valve needle, and the inner set of outlets is formed at a tip of the outer valve needle.

The inner and outer valve needles are controlled independently by two electromagnetic control valves, which are configured to control the pressure of a control fluid (normally diesel fuel) within respective control chambers for the inner and outer valve needles. Each control chamber is connected to a source of control fluid at relatively high pressure. Each control valve is operable to connect the respective control chamber to a low-pressure drain for the control fluid. In this way, opening of each control valve causes a reduction in the pressure of the control fluid in the corresponding control chamber, resulting in opening of the corresponding valve needle.

It is a challenge to accommodate the various injector components within an acceptable housing due to space limitations under the engine cover, particularly in a dual fuel injector where two actuators are required to provide the actuation means for the two valve needles.

It is with a view to addressing this problem that the present invention provides an improved fuel injector which is suitable for use in injecting two different fuel types.

SUMMARY OF THE INVENTION

Against that background, from a first aspect, the present invention resides in a fuel injector for an internal combustion engine, the injector comprising a first actuator for controlling movement of a first valve needle for injecting a first fuel into a cylinder of the engine, and a second actuator for controlling movement of a second valve needle for injecting a second fuel into the cylinder. Each of the actuators is axially spaced along a longitudinal axis of the injector body and comprises a respective conductive element for carrying current to the actuator. The injector further comprises an electrical connector module including first and second electrical connector means for connection with an associated one of the conductive elements for the actuators, and wherein the electrical connector module is mounted between the first and second actuators along the longitudinal axis of the injector body.

Preferably, the injector further comprises a first control valve assembly and a second control valve assembly, wherein the first actuator is operable to control the first control valve assembly and the second actuator is operable to control the second control valve assembly.

The first control valve assembly may be operable to control fuel pressure within a first control chamber associated with the first valve needle, thereby to control movement of the first valve needle, and wherein the second control valve assembly is operable to control fuel pressure within a second control chamber associated with the second valve needle, thereby to control movement of the second valve needle.

In one embodiment, the first and second control valve assemblies are housed within opposed ends of the injector body.

By way of example, the electrical connector module may project, at least in part, from a side of the injector body.

One benefit of the invention is that the electrical connector module may be mounted to the side of the injector body, to project laterally from the injector body, so that the overall height of the injector assembly is reduced compared to arrangements having a top-mounted connector. In addition, as both the first and second actuators share a common, integrated electrical connector module, the complexity and part-count is reduced.

The first and second actuators are electromagnetic actuators comprising a solenoid coil or winding, although other types of actuators may also be used.

In one embodiment, the electrical connector module includes a body portion, for example a barrel, which extends laterally from the injector body, and an insertion portion which is received within a chamber of the injector body to make electrical connection with the first and second conductive elements for the actuators.

The first and second conductive elements for the actuators may be housed, at least partially, within an elongate stem. The elongate stem of each of the first and second actuators may have its longitudinal axis offset laterally from the longitudinal axis of the injector body.

Each of the first and second electrical connector means may include a respective first or second pair of connector pins which extend axially through the electrical connector module for connection with the conductive element associated with the associated one of the first and second actuators.

The conductive elements may include an electrically conductive blade which includes a portion that is biased outwardly from the associated stem. The outward biasing of the blade portion ensures that a good electrical connection is made with the connector pins when they engage with the blades.

In one embodiment, the first and second pairs of connector pins are of different length, with the connector pins of one pair being of the same length, so that the shorter connector pins make contact with the conductive element spaced laterally closer to a module side of the injector body and the longer pins make contact with the conductive element spaced laterally further away from the module side. This is a particularly convenient arrangement to ensure that both the first and second actuators can be connected to a common electrical connector module.

The insertion portion may include first and second legs which are spaced apart so as to flank the electrical connector pins.

The insertion portion is provided with means for preventing incorrect insertion of the electrical connector module into the chamber.

For example, the insertion portion may be provided with a slot of relatively short length and a slot of relatively long length so that the actuator stem that is spaced laterally closer to a module side of the injector body can be accommodated within the slot of relatively long length.

It is helpful to ensure that incorrect assembly of the injector and the electrical connector module is not possible, and the feature of the slots is beneficial in this regard as it prevents the electrical connector module being inserted into the injector body the wrong way round.

BRIEF DESCRIPTION OF THE DRAWINGS

The invention will now be described, by way of example only, with reference to the following figures in which.

DETAILED DESCRIPTION OF EMBODIMENTS OF THE INVENTION

Figure 3:
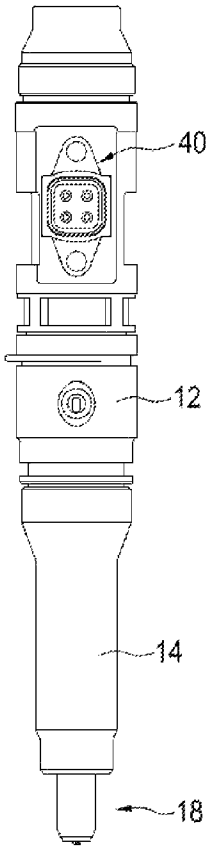
FIG. 3 is a view, from the side, of the fuel injector in FIGS. 1 and 2 to illustrate an electrical connector module of the injector.
Figure 2:
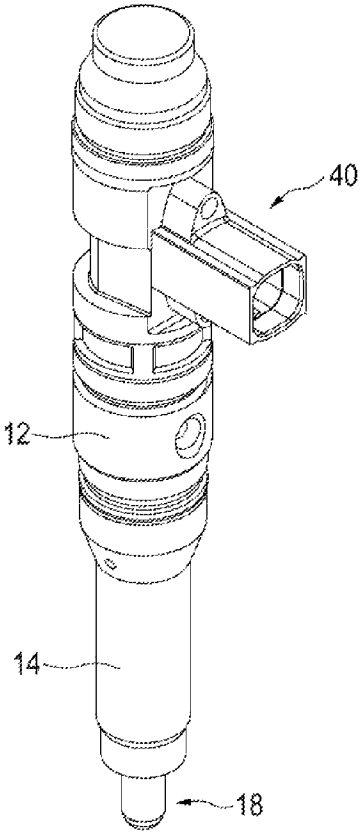
FIG. 2 is a perspective view of the fuel injector in FIG. 2.
Figure 1:
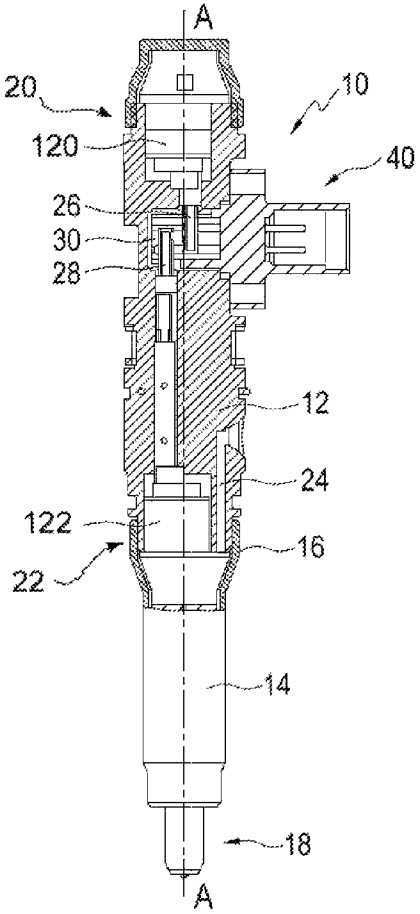
FIG. 1 is a section view of a fuel injector of an embodiment of the invention.

Referring to FIGS. 1 to 3, a fuel injector, referred to generally as 10, according to the present invention is generally elongate in form and has a central longitudinal injector axis A-A. The fuel injector comprises an injector body 12 and a nozzle body 14. The injector body 12 and the nozzle body 14 are held together in an end-to-end configuration by a cap nut 16.

A tip region 18 of the nozzle body 14 includes an outer set of outlets (not shown) and an inner outlet (also not shown). Injection of a first fuel through the outer set of outlets is controlled by a first or outer valve needle, and injection of a second fuel through the inner outlet is controlled by a second or inner valve needle. The inner and outer valve needles are not shown in the accompanying Figures but are housed within the nozzle body 14, with the inner needle being in concentric arrangement with, and internal to, the outer valve needle. The inner and outer valve needles are coaxial with the central injector axis A-A. Each of the inner and outer sets may include a single outlet, or a plurality of outlets. The injector may be configured to inject diesel fuel through the inner outlet(s) and natural gas through the outer outlet(s), or vice versa.

Movement of the inner and outer valve needles is controlled by means of first and second control valve assemblies, 20, 22 respectively, which control fuel pressure in first and second control chambers (not shown) associated with the inner and outer valve needles, respectively, in a manner which would be familiar to a person skilled in the art.

As shown most clearly in FIG. 1, the injector body is generally cylindrical. A high pressure fuel supply passage 24 extends through the injector body 12 to provide high pressure fuel to the nozzle body and the control chambers. A drain passage (not shown) provided in the injector body 12 allows high pressure fuel to flow to a low pressure reservoir.

The first control valve assembly 20 and the second control valve assembly 22 are both electromagnetically actuated by means of a respective electromagnetic actuator 120, 122. Each actuator has its own respective core (not shown) formed of a generally tubular pole piece and an electromagnetic solenoid coil or winding. A first solenoid coil of the first actuator 120 is disposed around a pole piece of the first actuator, and a second solenoid coil of the second actuator 122 is disposed around a pole piece of the second actuator. Further detail of the construction and operation of the actuators would be familiar to a person skilled in the art as is described, for example, in the Applicant's granted patent EP0740068B.

Each actuator is housed within the main injector body 12, together with the first and second control valves assemblies, 20, 22 respectively. The first control valve assembly 20 and the first actuator 20 are situated in an upper region of the injector body 12 and the second control valve assembly 22 and the second actuator 122 are situated in a lower region of the injector body 12. The first and second control valve assemblies, and their associated actuators, are therefore housed at opposed ends of the injector body 12.

The first control valve assembly includes a first control valve member that is slidably received in a bore in the upper region of the injector body 12. The first control valve member is attached to a first armature that is movable in response to the electromagnetic field generated as a result of current being applied to the first solenoid coil. In a similar fashion, the second control valve assembly includes a second control valve member that is slidably received in a bore in the lower region of the injector body. The second control valve member is attached to a second armature that is movable in response to the electromagnetic field generated as a result of current being applied to the second solenoid coil.

Figure 4:
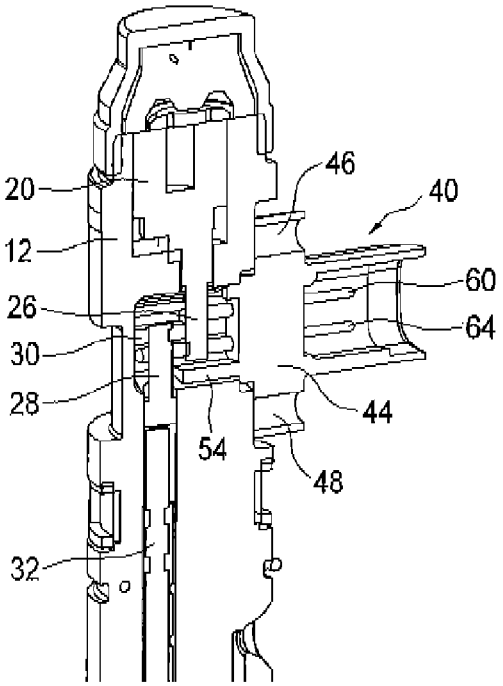
FIG. 4 is a perspective view of a section of the fuel injector in FIGS. 1 to 3, to more clearly illustrate the electrical connection of the connector module to the injector.

As can be seen most clearly in FIG. 4, the first control valve assembly includes a first stem 26 within which an electrically conductive element is housed which connects with the solenoid of the first actuator. Likewise, the second control valve assembly includes a second stem 28 within which an electrically conductive element is housed which connects with the solenoid of the second actuator.

The first stem 26 of the first control valve assembly extends downwardly within the upper region of the injector body 12 and projects into a connector chamber 30 formed part way along the length of the injector body 12. The first stem 26 is eccentric to, and radially displaced from, the axis of the first control valve member, and hence to the first solenoid coil, and is eccentric to, and radially displaced from, the central axis A-A of the injector body 12.

The second stem 28 of the second control valve assembly extends upwardly within the lower region of the injector body 12 and also projects into the connector chamber 30. The second stem 28 is eccentric to, and displaced radially from, the axis of the second control valve member, and hence to the second solenoid coil, and is also eccentric to, and radially displaced from, the central axis A-A of the injector body 12.

Figure 5:
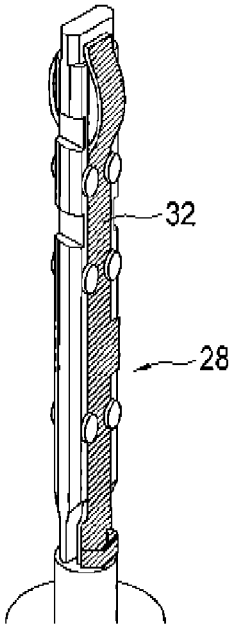
FIG. 5 is a perspective view of an electrically conductive blade of the injector in FIGS. 1 to 4, which connects with the electrical connector module.

Referring also to FIG. 5, the electrically conductive elements housed within the stems 26, 28 are flat electrical conductors in the form of blades which provide an electrically conductive path to the associated solenoid. FIG. 5 illustrates just a single one of the blades 32 of the upwardly directed stem 28.

On each stem 26, 28, a first blade includes a portion that is biased outwardly to project laterally from a first side of the stem, whilst a second blade includes a portion that is biased outwardly to project laterally from a second side of the stem. The pair of blades associated with each stem is arranged to connect with an electrical connector module of the injector, referred to generally as 40. The electrical connector module connects with an external power supply (not shown) for the engine, to allow current to be supplied to the solenoids of the actuators, via the blades, as will be described in further detail below.

The first and second control valve assemblies 20, 22 are identical to one another, but with one having its stem offset to one side of the injector axis A-A and the other having its stem offset to the other side of the injector axis A-A.

The first control valve member is biased into a first position, known as a filling position, by a first biasing spring (not shown). When the first solenoid coil is energised, the associated armature is caused to move such that the first control valve member is drawn into a second position, known as a drain position. Similarly, the second control valve is biased into a first position, known as a filling position, by a second biasing spring. When the second coil is energised, the armature of the second control valve member is caused to move so as to draw the second control valve member into a second position, known as a drain position.

By controlling the first and second control valve members to move between their filling and drain positions, fuel pressure within control chambers associated with the inner and outer valve needles is controlled. In this way opening and closing movement of the inner and outer valve needles can be controlled to control the injection of the first and second fuels into the combustion chamber in accordance with a chosen injection strategy.

Referring in more detail to FIGS. 4 to 10, the electrical connector module 40 is provided to enable current to be supplied to the first and second solenoids, thereby to control actuation of the first and second control valve assemblies 20, 22.

Figure 7:
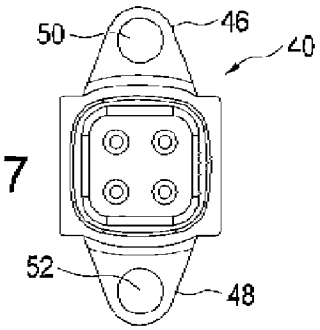
FIG. 7 shows a view, from a first end, of the electrical connector module in FIG. 6, to illustrate the position of electrical pins of the module.
Figure 9:
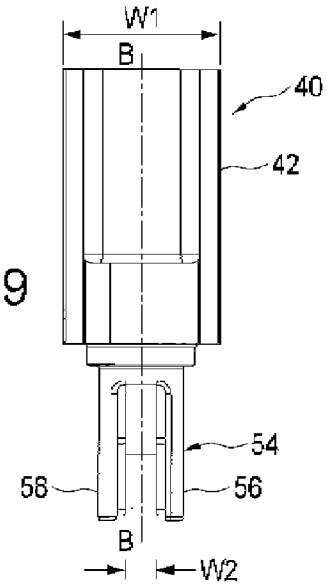
FIG. 9 is a side view of the electrical connector module in FIGS. 6 to 8.
Figure 6:
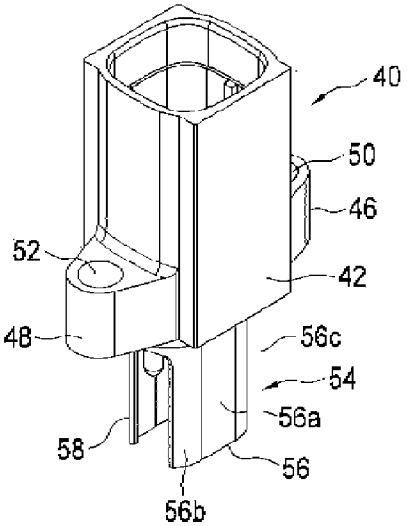
FIG. 6 is a perspective view of the electrical connector module for the injector illustrated in FIGS. 1 to 5.

The electrical connector module 40 includes a connector body in the form of a hollow body portion or barrel 42 which is of generally square external cross section having an external width, W1, as best seen in FIGS. 6 and 7. The hollow of the barrel 42 is of generally square cross section, but with rounded corners. At the base of the barrel, a support 44 is provided which extends through the barrel 42 but is of greater length than the width, W1, so as to extend laterally from the barrel 42, to define first and second mounting flanges 46, 48, one on either side of the barrel. The mounting flanges provide a means for mounting the connector housing to the injector body via holes, 50, 52, respectively, which are drilled through the flanges for receiving a mounting bolt (not shown).

The electrical connector module 40 further includes an insertion portion 54 for receipt within the connector chamber 30 of the injector. The insertion portion 54 includes first and second opposed legs 56, 58 which extend from the support 44 at the base of the barrel 42, on the other side of the support from the barrel. Each of the legs 56, 58 includes a flat central portion flanked on each side by a curved portion. For the first leg 56, the flat portion is indicated by reference numeral 56*a* and the curved portions on either side are indicated by reference numerals 56*b*, 56*c*. Each of the first and second legs is shaped for receipt within the connector chamber 30 of the injector body 12 so that, with the legs 56, 58 received within the connector chamber 30, the barrel of the electrical connector module projects laterally from the injector body 12. The connector module defines a central connector axis B-B which, when the module is mounted to the injector body 12, extends perpendicularly to the central injector axis A-A, as indicated in FIG. 8.

The width of the barrel, W1, is greater than the spacing between the first and second legs 56, 58 so that the module has a stepped outer profile. The separation between the first and second legs is defined by width, W2.

The module is of moulded construction so that the barrel 40, the support 44 and the legs 56, 58 are all formed as an integrated part which supports electrical connector means of the module, comprising four electrical connectors pins 60, 62, 64, 66.

Figure 8:
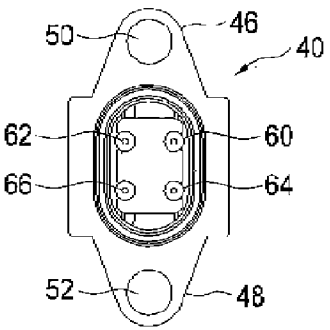
FIG. 8 shows a view, from the opposite end to that shown in FIG. 7, of the electrical connector module.

FIG. 7 shows an end view of the connector module 40 viewed externally, along the axis B-B of the module, into the injector body 12, whereas FIG. 8 shows an end view of the connector module 40 viewed internally, along the axis B-B of the module, from within the injector body 12. Referring to FIG. 8 in particular, the four electrical connector pins 60, 62, 64, 66 extend axially through the barrel 42 and are supported by the support 44, without making contact with the internal surface of the barrel. On the other side of the support 44, the pins 60, 62, 64, 66 project into the space defined between the opposed legs 56, 58 of the insertion portion 56. A first pair of pins 60, 62 is associated with the first control valve assembly 20 and a second pair of pins 64, 66 is associated with the second control valve assembly 22.

The pins 60, 62 of the first pair are arranged horizontally next to one another, spaced apart with one on each side of the central axis B-B of the module 40. In a similar fashion, the pins 64, 66 of the second pair are arranged horizontally next to one another, spaced apart, with one on each side of the central axis B-B of the module 40. The pins 60, 62 of the first pair lie vertically above the pins 64, 66 of the second pair so that the spacing between each pin and each of its neighbouring, adjacent pins is substantially identically. The pins 60, 62 of the first pair have a shorter length than the pins 64, 66 of the second pair.

When the electrical connector module 40 is inserted into the connector chamber 30, each of the short pins 60, 62 engages with an associated one of the blades of the downwardly extending stem 26. In a similar fashion, each of the long pins 64, 66 engages with an associated one of the blades of the upwardly extending stem 28. The outward biasing of the blades ensures that a good electrical connection is made between each pin/blade pair.

Figure 10:
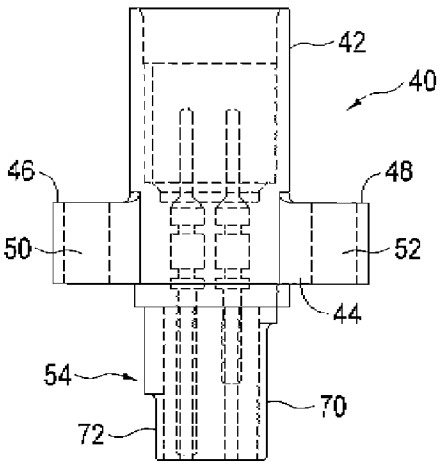
FIG. 10 is a sectional view of the electrical connector module in FIGS. 6 to 9, to illustrate the position of the connector pins of the module along its axis.

As can be seen most clearly in FIG. 10, each leg 56, 58 of the insertion portion 54 is provided with a feature in the form of a slot 70, 72 which is provided to ensure correct mounting of the electrical connector module 40 to the injector. At the upper edge of each leg 56, 58, a first axial slot 70 of relatively long length is provided (referred to as the long slot) for receiving the downwardly extending stem 26 when the module 40 is inserted into the connector chamber 30. At the lower edge of each leg 56, 58, a second axial slot 72 of relatively short length is provided (referred to as the short slot) for receiving the upwardly extending stem 28 when the module 40 is inserted into the connector chamber 30. The provision of the long slot 72 ensures that as the legs are inserted into the connector chamber 30 in, the downwardly extending stem 26 of the first (upper) actuator, which lies laterally closer to the module side of the injector body than the upwardly extending stem 28 of the second actuator, can be accommodated within the long slot 72.

As the upwardly extending stem 28 of the second (lower) actuator is displaced laterally further from the module side of the injector body, the shorter slot 70 is sufficient to accommodate the second stem 28. The provision of the slot features 70, 72 ensures that the electrical connector module 40 cannot be inserted into the connector chamber 30 the wrong way round (i.e. upside down), and thereby ensures the correct electrical connections are made to the solenoids.

In use, movement of the inner and outer valve needles is controlled hydraulically by varying the pressure of control fluid or fuel in the associated control chambers. When the first control valve assembly 20 is actuated, the first control valve member is in its drain position and fuel pressure within the control chamber is relatively low. The inner valve needle is therefore lifted away from its seating to allow injection of the first fuel through the associated outlets. When the first control valve assembly 20 is de-actuated by removing or reducing the current applied to the solenoid via the electrical connector module 40, the first control valve member is moved into its filling position, increasing fuel pressure within the associated control chamber and seating the valve needle to terminate injection of the first fuel.

The second control valve assembly is operated in the same way by varying the current that is applied to the second actuator via the electrical connector module 40 so as to control injection of the second fuel.

By arranging the first and second control valve assemblies so that they share a common or integrated electrical connector module 40, the accommodation space required for the injector installation is reduced compared to an arrangement in which separate electrical connectors are required for each control valve assembly. In addition, as the electrical connector module 40 is arranged to extend laterally from the injector housing 12, as opposed to a top-mounted connector, the height of the complete injector assembly is reduced so that it can more easily be accommodated in the space beneath the engine cover.

A further benefit of the electrical connector module is that the contact between the electrical pins 60, 62, 64, 66 and the electrically conductive blades of the stems is secure and does not involve convoluted paths for connecting wires through the injector body 12.

Further modifications and variations not explicitly described above can also be contemplated without departing from the scope of the invention as defined in the appended claims.

The invention claimed is:

1. A fuel injector for an internal combustion engine, comprising:

an injector body, a first actuator for controlling movement of a first valve needle for injecting a first fuel into a cylinder of the engine, and a second actuator for controlling movement of a second valve needle for injecting a second fuel into the cylinder, each of the actuators being axially spaced along a longitudinal axis of the injector body and each of the actuators comprising a respective elongate stem with each stem at least partially housing a conductive element for carrying current to the associated actuator, the injector further comprising an electrical connector module including first and second electrical connectors for connection with an associated one of the conductive elements, and wherein the electrical connector module is mounted between the first and second actuators along the longitudinal axis of the injector body.

2. The fuel injector as claimed in claim 1, further comprising a first control valve assembly and a second control valve assembly, wherein the first actuator is operable to control the first control valve assembly and the second actuator is operable to control the second control valve assembly.

3. The fuel injector as claimed in claim 2, wherein the first control valve assembly is operable to control fuel pressure within a first control chamber associated with the first valve needle, thereby to control movement of the first valve needle, and wherein the second control valve assembly is operable to control fuel pressure within a second control chamber associated with the second valve needle, thereby to control movement of the second valve needle.

4. The fuel injector as claimed in claim 2, wherein the first and second control valve assemblies are housed within opposed ends of the injector body.

5. The fuel injector as claimed in claim 1, wherein the electrical connector module projects, at least in part, from a side of the injector body.

6. The fuel injector as claimed in claim 1, wherein the first and second actuators are electromagnetic actuators comprising a solenoid coil or winding.

7. The fuel injector as claimed in claim 1, wherein the elongate stem of each of the first and second actuators has its longitudinal axis offset laterally from the longitudinal axis of the injector body.

8. The fuel injector as claimed in claim 7, wherein each of the first and second electrical connectors includes a respective first or second pair of connector pins which extend axially through the electrical connector module for connection with the conductive element associated with the associated one of the first and second actuators.

9. The fuel injector as claimed in claim 8, wherein each of the conductive elements includes an electrically conductive blade which is biased outwardly from the associated stem.

10. The fuel injector as claimed in claim 8, wherein the first and second pairs of connector pins are of different length, with the connector pins of one pair being of the same length, so that the shorter connector pins make contact with the conductive element spaced laterally closer to a module side of the injector body and the longer pins make contact with the conductive element spaced laterally further away from the module side.

11. The fuel injector as claimed in claim 1, wherein the electrical connector module includes a body portion which extends laterally from the injector body and an insertion portion which is received within a chamber of the injector body to make electrical connection with the conductive elements.

12. The fuel injector as claimed in claim 11, wherein the insertion portion includes first and second legs which are spaced apart so as to flank the electrical connector pins.

13. The fuel injector as claimed in claim 11, wherein the insertion portion is provided with means for preventing incorrect insertion of the electrical connector module into the chamber.

14. The fuel injector as claimed in claim 13, wherein the insertion portion is provided with a slot of relatively short length and a slot of relatively long length so that the actuator stem that is spaced laterally closer to a module side of the injector body can be accommodated within the slot of relatively long length.

15. The fuel injector as claimed in claim 2, wherein the elongate stem of each of the first and second actuators has its longitudinal axis offset laterally from the longitudinal axis of the injector body.

16. The fuel injector as claimed in claim 3, wherein the elongate stem of each of the first and second actuators has its longitudinal axis offset laterally from the longitudinal axis of the injector body.

17. The fuel injector as claimed in claim 4, wherein the elongate stem of each of the first and second actuators has its longitudinal axis offset laterally from the longitudinal axis of the injector body.

18. The fuel injector as claimed in claim 5, wherein the elongate stem of each of the first and second actuators has its longitudinal axis offset laterally from the longitudinal axis of the injector body.

19. The fuel injector as claimed in claim 6, wherein the elongate stem of each of the first and second actuators has its longitudinal axis offset laterally from the longitudinal axis of the injector body.

20. The fuel injector as claimed in claim 9, wherein the first and second pairs of connector pins are of different length, with the connector pins of one pair being of the same length, so that the shorter connector pins make contact with the conductive element spaced laterally closer to a module side of the injector body and the longer pins make contact with the conductive element spaced laterally further away from the module side.

* * * * *